US010815745B2

(12) United States Patent
Dewey et al.

(10) Patent No.: US 10,815,745 B2
(45) Date of Patent: Oct. 27, 2020

(54) THRU-CASING SECTION MILL

(71) Applicant: Wellbore Integrity Solutions LLC, Houston, TX (US)

(72) Inventors: Charles H. Dewey, Houston, TX (US); Mahesha Kumar, Cypress, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 256 days.

(21) Appl. No.: 15/755,594

(22) PCT Filed: Aug. 9, 2016

(86) PCT No.: PCT/US2016/046206

§ 371 (c)(1),
(2) Date: Feb. 27, 2018

(87) PCT Pub. No.: WO2017/039983

PCT Pub. Date: Mar. 9, 2017

(65) Prior Publication Data

US 2019/0024461 A1 Jan. 24, 2019

Related U.S. Application Data

(60) Provisional application No. 62/211,700, filed on Aug. 29, 2015.

(51) Int. Cl.
*E21B 29/00* (2006.01)

(52) U.S. Cl.
CPC ..... *E21B 29/005* (2013.01)

(58) Field of Classification Search
CPC ..... E21B 10/327; E21B 10/26; E21B 10/38; E21B 10/30; E21B 10/32; E21B 10/322; E21B 10/34; E21B 10/345; E21B 29/005
See application file for complete search history.

(56) References Cited

U.S. PATENT DOCUMENTS

| | | | |
|---|---|---|---|
| 3,295,604 | A | 1/1967 | Cordary |
| 4,938,291 | A | 7/1990 | Lynde et al. |
| 5,010,955 | A | 4/1991 | Springer |

(Continued)

FOREIGN PATENT DOCUMENTS

| | | | |
|---|---|---|---|
| RU | 56931 | U1 | 9/2006 |
| WO | 2010054407 | A1 | 5/2010 |

OTHER PUBLICATIONS

International Search Report and Written Opinion issued in International Patent Application PCT/US2016/046206, dated Nov. 17, 2016, 16 pages.

(Continued)

*Primary Examiner* — Robert E Fuller
(74) *Attorney, Agent, or Firm* — Hubbard Johnston PLLC

(57) ABSTRACT

A milling tool includes a cutting block in a recess in a tool body. The cutting block is configured to extend radially outward from and retract radially inward toward the tool body. The milling tool further includes a milling blade in a recess or cut-out in the cutting block. The milling blade is configured to extend radially outward from and inwards toward the cutting block. One or more links may couple the milling blade to the tool body to cause the milling blade to move radially relative to the cutting block when the cutting block moves radially relative to the tool body. The milling tool may be used as a dual string section mill to remove any of an inner casing, an outer casing, or cement between the inner and outer casings.

23 Claims, 8 Drawing Sheets

(56) References Cited

U.S. PATENT DOCUMENTS

| | | | |
|---|---|---|---|
| 5,014,780 | A | 5/1991 | Skipper |
| 5,074,355 | A | 12/1991 | Lennon |
| 5,899,268 | A | 5/1999 | Lynde et al. |
| 6,125,929 | A | 10/2000 | Davis et al. |
| 6,920,923 | B1 | 7/2005 | Pietrobelli et al. |
| 7,401,666 | B2 | 7/2008 | Fanuel et al. |
| 7,823,632 | B2 | 11/2010 | McAfee et al. |
| 7,909,100 | B2 | 3/2011 | Bryant, Jr. et al. |
| 8,540,035 | B2 | 9/2013 | Xu et al. |
| 8,555,955 | B2 | 10/2013 | Davis |
| 8,794,354 | B2 | 8/2014 | Xu et al. |
| 8,807,246 | B2 | 8/2014 | Lassoie et al. |
| 8,955,597 | B2 | 2/2015 | Connell et al. |
| 8,991,489 | B2 | 3/2015 | Redlinger et al. |
| 9,022,117 | B2 | 5/2015 | Segura et al. |
| 9,097,073 | B2 | 8/2015 | Schmidt et al. |
| 9,187,971 | B2 | 11/2015 | Hutchinson |
| 9,617,815 | B2 | 4/2017 | Schwartze et al. |
| 9,695,660 | B2 | 7/2017 | Ruttley |
| 9,725,977 | B2 | 8/2017 | Laird et al. |
| 2011/0220357 | A1 | 9/2011 | Segura et al. |
| 2012/0305249 | A1 | 12/2012 | Connell et al. |
| 2012/0325480 | A1 | 12/2012 | Schmidt et al. |
| 2014/0332200 | A1 | 11/2014 | Ruttley |
| 2015/0096753 | A1 | 4/2015 | Kulage |
| 2015/0101812 | A1 | 4/2015 | Bansal et al. |
| 2015/0292289 | A1 | 10/2015 | Schmidt et al. |
| 2017/0009546 | A1 | 1/2017 | Krieg et al. |

OTHER PUBLICATIONS

International Preliminary Report on Patentability issued in International Patent Application No. PCT/US2016/046206 dated Mar. 15, 2018, 12 pages.

THRU-CASING SECTION MILL

CROSS-REFERENCE TO RELATED APPLICATIONS

This application is the U. S. national phase of International Patent Application No. PCT/US2016/046206, filed Aug. 9, 2016, and entitled "Thru-Casing Section Mill," which claims the benefit of, and priority to, U.S. Patent Application No. 62/211,700, filed Aug. 29, 2015, and entitled "Thru-Casing Section Mill," which application is expressly incorporated herein by this reference in its entirety.

BACKGROUND

Oil and gas wells are ordinarily completed by first cementing metallic casing strings in a wellbore. Depending on the properties of the formation and the wellbore, two or more casing strings may be employed. For example, a smaller diameter string may be deployed internal to a larger diameter string. In such dual-string wellbores, the internal string is commonly cemented to the larger diameter string by filling the annular region between the inner and outer strings with cement.

When oil and gas wells are no longer commercially viable, they are abandoned. Procedures and governmental regulations for well abandonment vary from one jurisdiction to another; however, they generally include placing one or more permanent barriers to isolate the wellbore. In certain jurisdictions, well abandonment regulations specify that a length (e.g., 50 or more meters) of the wellbore casing string is to be removed prior to filling the wellbore with a cement plug. The casing string may be removed via a section milling operation that employs a set of circumferentially spaced milling/cutting blades that extend radially from a tool body. During a section milling operation, the section mill is deployed on a tool string and rotated in the wellbore such that the blades make a circumferential cut-out in the metallic casing string. The tool string is then moved axially, while rotation continues, so as to axially mill and remove the desired length of the casing string.

Milling a dual-string wellbore generally includes tripping the section mill out of the hole and performing a similar process with a section mill having larger diameter blades. A separate drilling operation (and downhole trip) may also be used to remove the cement layer located between the inner and outer strings.

SUMMARY

One or more embodiments of the present disclosure relate to a downhole tool having a tool body and a block in a recess in the tool body. The block may be radially movable relative to the tool body between expanded and retracted states. A blade may be recessed relative to the cutting block and movable relative to the cutting block between expanded and retracted states. One or more links may couple the milling blade to the tool body.

In one or more embodiments, a downhole milling tool may include a tool body, cutting blocks, and milling blades. The tool body may include recesses in an external surface and may be further configured to couple to a tool string. The cutting blocks may be positioned in the recesses in the tool body and configured to extend radially outward relative to a central axis of the tool body toward an extended position, and to retract radially inward relative to the central axis toward a retracted position. The milling blades may be located in cut-outs, slots, or other recesses of the cutting blocks and configured to extend radially outward relative to the cutting block to extended positions, and to retract radially inward relative to the cutting block toward retracted positions. At least one link may also be pinned to each milling blade and to the tool body.

According to some embodiments, a method for milling a casing string in a wellbore may include rotating a milling tool at a starting downhole position in a wellbore. The milling tool may include a cutting block in a tool body and a milling blade in the cutting block. A link may couple the tool body to the milling blade. The cutting block can be extended radially outward relative to the tool body while simultaneously extending the milling blade radially outward relative to the cutting block. An outer casing string can be cut with the milling blade, and the milling tool can be moved axially with the cutting block and milling blades in extended positions to cause the cutting block and milling blade to remove an axial section of the outer casing. In some embodiments, the outer casing may be cut through a section of inner casing that has been, or is currently being, removed. In such embodiments, the milling tool may be considered a dual casing mill (or section mill) or a thru-casing mill (or section mill).

This summary has broadly introduced several features and aspects of one or more embodiments in order that the detailed description of the embodiments that follow may be better understood. This summary is not intended to identify key or essential features of the claimed subject matter, nor is it intended to be used as an aid in limiting the scope of the claimed subject matter. Additional features and aspects of one or more embodiments will be described hereinafter. Furthermore, those skilled in the art will also appreciate that the specific embodiments disclosed may be readily utilized as a basis for additional modifications for carrying out the same purposes of the disclosed subject matter, without departing from the spirit and scope of the present disclosure.

BRIEF DESCRIPTION OF THE DRAWINGS

For a more complete understanding of the present disclosure and the embodiments herein, reference is now made to the detailed description taken in conjunction with the accompanying drawings, in which:

FIG. 2-1 is a cross-sectional view of a downhole tool with a retracted milling structure, in accordance with some embodiments of the present disclosure.

FIG. 2-2 is a cross-sectional view of the downhole tool of FIG. 2-1 with an expanded milling structure, in accordance with some embodiments of the present disclosure.

FIG. 2-3 is a perspective view of a cutter block of the downhole tool of FIG. 2-1, in accordance with some embodiments of the present disclosure.

FIG. 2-4 is a perspective view of a milling blade of the downhole tool of FIG. 2-1, in accordance with some embodiments of the present disclosure.

FIG. 3-1 is a cross-sectional view of a downhole tool with a retracted milling structure, in accordance with some embodiments of the present disclosure.

FIG. 3-2 is a cross-sectional view of the downhole tool of FIG. 3-1 with an expanded milling structure, in accordance with some embodiments of the present disclosure.

FIG. 3-3 is a perspective view of a cutter block of the downhole tool of FIG. 3-1, in accordance with some embodiments of the present disclosure.

FIG. 3-4 is a perspective view of a milling blade of the downhole tool of FIG. 3-1, in accordance with some embodiments of the present disclosure.

FIG. 4-1 is a cross-sectional view of a downhole tool with a retracted milling structure, in accordance with some embodiments of the present disclosure.

FIG. 4-2 is a cross-sectional view of the downhole tool of FIG. 4-1 with an expanded milling structure, in accordance with some embodiments of the present disclosure.

FIG. 4-3 is a perspective view of a cutter block of the downhole tool of FIG. 4-1, in accordance with some embodiments of the present disclosure.

FIG. 4-4 is a perspective view of a milling blade of the downhole tool of FIG. 4-1, in accordance with some embodiments of the present disclosure.

DETAILED DESCRIPTION

Figure 1:
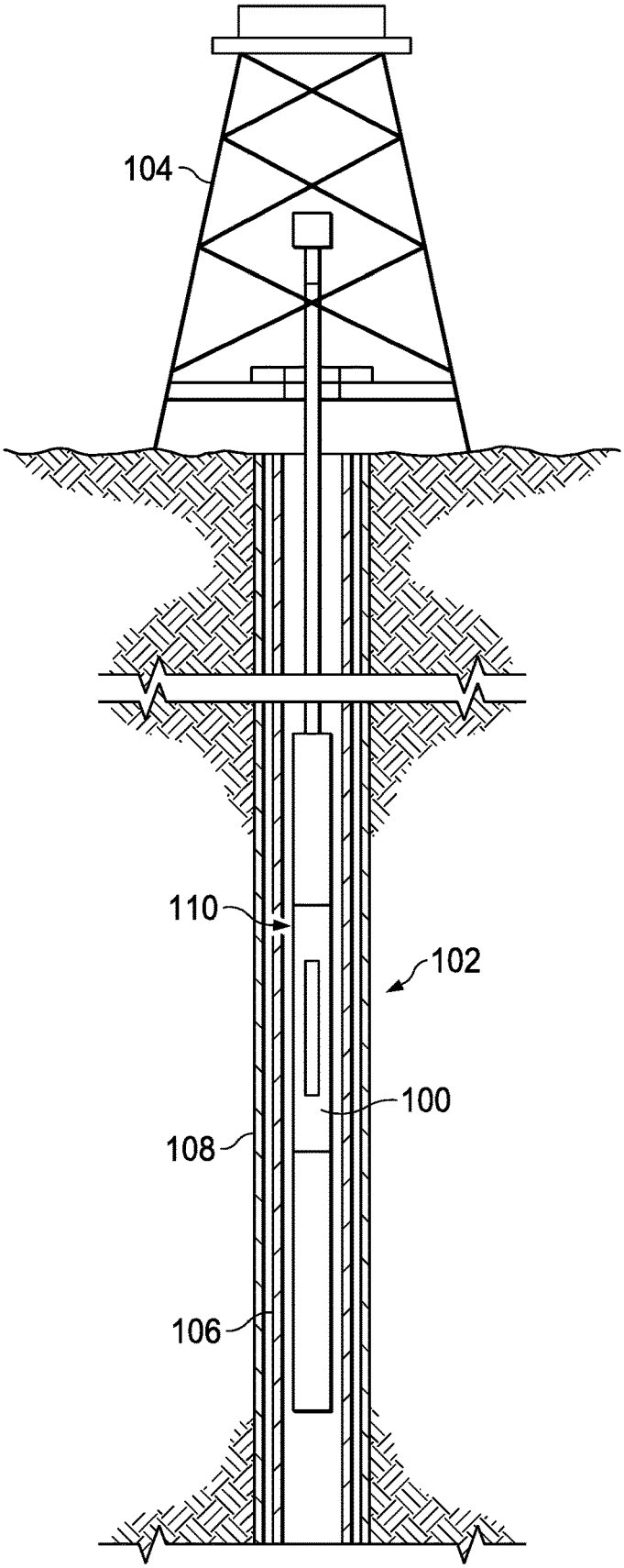
FIG. 1 schematically illustrates a drilling system on which downhole tool embodiments in accordance with the present disclosure may be utilized.

FIG. 1 depicts a downhole tool 100 in accordance with some embodiments of the present disclosure. In some embodiments, for instance, the downhole tool 100 may include a section mill for milling through casing in a wellbore 102. The section mill or other downhole tool 100 may be used, for example, to mill an inner casing string, to mill an outer casing string through a previously opened section of an inner casing string, to simultaneously mill through inner and outer casing strings, or to sequentially mill through an inner casing string and then expand to mill through the outer casing string.

The downhole tool 100 may be deployed in the wellbore 102 using a rig 104 positioned in the vicinity of a subterranean oil or gas formation. The rig 104 may include, by way of example, a derrick and a hoisting apparatus for lowering and raising various components into and out of the wellbore 102. The wellbore 102 may be fully or partially cased using a string of metallic casing/liner strings. In FIG. 1, the wellbore 102 is shown as having dual casing strings with an inner casing string 106 inside an outer casing string 108. In other embodiments, a single casing string may be used, or more than two casing strings may be present. In some embodiments, one or more casing strings may not extend fully to the surface, but may instead be liner strings suspended from another casing string.

A tool string 110 including the downhole tool 100, and configured in accordance with one or more embodiments of the present disclosure, is depicted as being run into the wellbore 102. The downhole tool 100 may include at least one cutting block and/or milling blade combination is configured for milling the inner casing string 106 and/or the outer casing string 108. It will be understood in view of the disclosure herein that the tool string 110 may include other suitable components and other downhole tools for use in performing a particular downhole operation, and that the embodiments disclosed herein are not limited to any particular tool combination, rig configuration, derrick, or hoisting apparatus.

Figures 1, 2:
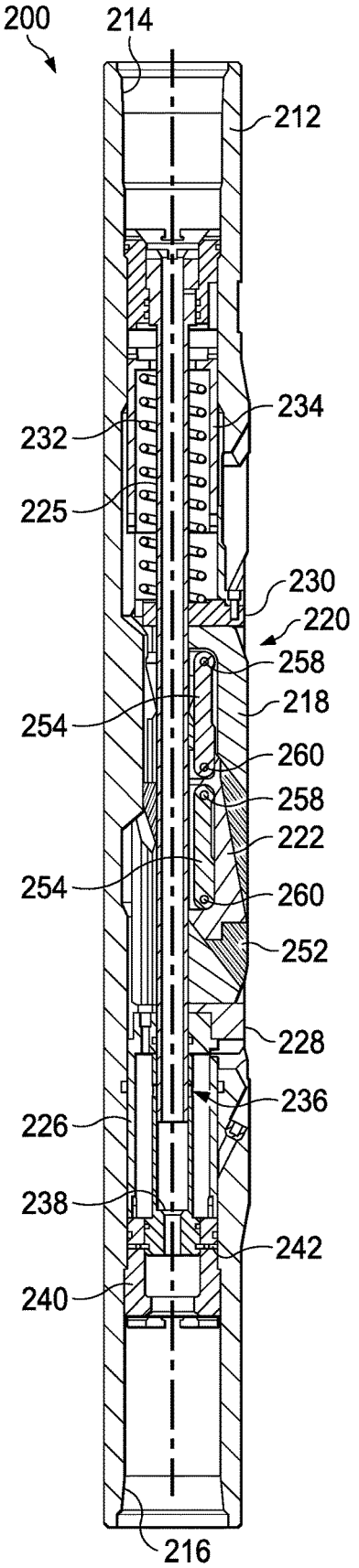
Figure 2:
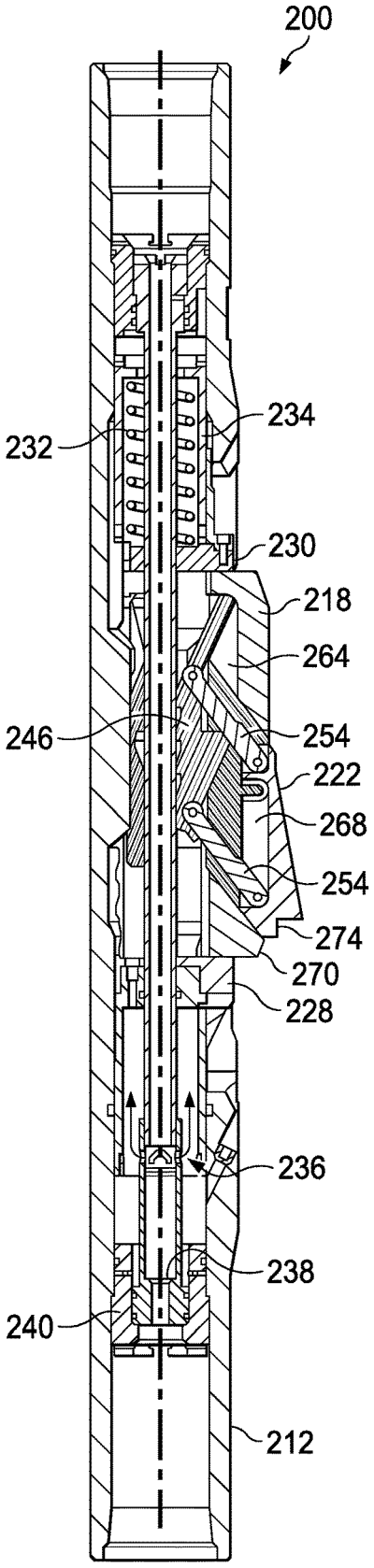

FIGS. 2-1 and 2-2 are cross-sectional views of an illustrative downhole tool 200 in accordance with some embodiments of the present disclosure. In at least some embodiments, the downhole tool 200 may be used in a tool string (e.g., tool string 110) to remove casing, cement, formation, or other elements within a wellbore. Accordingly, the downhole tool 200 may include a tool body 212 suitable for coupling with a drill string or other tool string. For instance, the tool body 212 may include uphole and downhole threaded end portions 214, 216 to facilitate coupling with drill pipe, drill collars, transition drill pipe, other downhole tools, other components, or any combination of the foregoing.

A plurality of circumferentially-spaced cutting blocks 218 (one is shown) may be positioned in corresponding recesses 220 extending radially through a thickness of the tool body 212 and along an axial length of the tool body 212. The cutting blocks 218 are configured to move between radially retracted positions (see FIG. 2-1) and radially extended positions (see FIG. 2-2) relative to the tool body 212. Milling blades 222 (one is shown) may be positioned with one or more in a slot or recess 224 (see FIG. 2-3) extending at least partially radially through, and axially along, each of the cutting blocks 218. The milling blades 222 may also be configured to move between radially retracted positions (see FIG. 2-1) and one or more radially extended positions (see FIG. 2-2) relative to the cutting block 218 and/or the tool body 212.

The downhole tool 200 is an example of any number of embodiments which are within the scope of the present disclosure; however, the operation of the downhole tool 200 will be described to provide an understanding of how some embodiments of the present disclosure may be used to perform a downhole operation. The tool body 212 may define a bore extending at least partially along a longitudinal axis of the tool body 212. Fluid may flow through the bore to one or more components coupled to the tool body 212, to the annulus of a wellbore around the downhole tool 200 and a surrounding casing or wellbore wall, or to other locations or components. In some embodiments, the fluid may also be used to activate the downhole tool 200. For instance, a mandrel 225 in the bore of the tool body 212 may receive fluid, and direct the fluid toward a downhole end portion of the tool body 212. Fluid may flow from the mandrel 225 and into a chamber of a piston 226. The chamber of the piston 226 may selectively receive the fluid in some embodiments. When fluid is received in the chamber of the piston 226, the fluid may build hydraulic pressure to cause the piston 226 to move, thereby also moving a drive ring 228 axially within the tool body 212. For instance, the drive ring 228 may move axially from the position in FIG. 2-1 to the further uphole position in FIG. 2-2. The drive ring 222 may in turn directly or indirectly engage a downhole end portion of the cutting blocks 218, and may push the cutting blocks 218 in an uphole direction.

An uphole end portion of the cutting blocks 218 may directly or indirectly engage a stop ring 230. The stop ring 230 may be biased in a downhole direction by a biasing element such as spring 232. With sufficient hydraulic pressure acting on the piston 226, the drive ring 228 and the cutting block 218 may move and exert a force on the stop ring 230 that overcomes the biasing force of the spring 232 to move the stop ring 230 in an uphole direction. As shown in FIG. 2-2, the stop ring 230 may engage a shoulder or other surface (here a lower end portion of a spring retainer 234) which may stop, slow, or otherwise restrict uphole movement of the stop ring 230. With hydraulic pressure maintained, the stop ring 230 may remain in the uphole position, which may correspond to radially extended positions of the cutting block 218 and the milling blade 222. As hydraulic pressure is reduced, the biasing force of the spring 232 may push the stop ring 230 in a downhole direction, thereby also moving the cutting blocks 218 and drive ring 228 in a downhole direction. When fluid flow is stopped (e.g., through the mandrel 225 or into the chamber of the piston 226) or provides an insufficient force to overcome any of the bias of the spring 232, the drive ring 228, cutting block 218, milling blade 222, and stop ring 230 may return to the corresponding positions shown in FIG. 2-1.

Any number of mechanisms may be used to selectively allow fluid to activate the downhole tool 200. For instance, an actuator may open or close one or more ports 236 that allow fluid to flow into the piston 226. In the illustrated embodiment, the actuator may include a movable ball seat 238 coupled to a stop block 240 or to the tool body 212 by one or more shear elements (e.g., shear pins 242). A ball, dart, or other obstruction device (not shown) may be dropped through the bore of the body 212 and rest on the ball seat 238 and obstruct flow. Fluid pressure may build behind the obstruction device, which can exert a downhole directed force on the ball seat 238. The force can exceed the rating of the shear pins 242 and cause them to shear or otherwise break, thereby allowing the ball seat 238 to move further downhole. This movement can also allow the ports 236 to move axially from an obstructed or sealed position (e.g., where the ports 236 in the ball seat 238 or a sleeve coupled thereto are not aligned with corresponding ports or openings in the mandrel 225 as shown in FIG. 2-1) to an open position (e.g., where the ports 236 are aligned with corresponding ports or openings in the mandrel 225 as shown in FIG. 2-2) allowing fluid to flow into the piston 226.

Any number of other types of actuators may also be used. For instance, the ports 236 may be moved or opened in response to fluid pressure changes that cause an indexing track to index between active and inactive positions. In other embodiments, a downhole controller and/or sensor may be used to detect changes in flow rate, fluid pressure, tool rotation, or the like. Predetermined signals may have patterns of flow rate, pressure, rotation, or other such changes and the actuator can recognize such signals and then open or close the ports using an electric motor, a solenoid valve, an axial or rotary valve, or any other suitable mechanism. In the same or other embodiments, radio-frequency identification (RFID) tags, different fluids, or other physical elements may be inserted into the well and flowed to the downhole tool 200. The actuator may include a sensor detecting the presence of such materials or elements, and may open or close the ports 236 in response to such detection. In some embodiments, an actuator may also control the amount of flow through the ports 236 or otherwise control start and/or end positions for the drive ring 228, stop ring 230, cutting blocks 218, or the like. Such control may allow selective control of the radial expansion of the cutting blocks 218 and/or the milling blades 222, thereby allowing one or more intermediate radial positions between a fully retracted and fully expanded position.

The cutting blocks 218 and/or the milling blades 222 may radially expand or retract in response to the axial movement of the cutting blocks 218. In some embodiments, the milling blade 222 may be biased radially inwardly towards the longitudinal axis of the tool body 212. Such a bias may include one or more biasing elements such as springs or resilient members (not shown). In the same or other embodiments, a connection between the milling blade 222 and the cutting block 218 may bias the milling blade 222 radially inwardly when the cutting block 218 is in a radially retracted position. Optionally, the connection may also bias the milling blade 222 radially outwardly relative to the cutting block 218 when the cutting block 218 is in a radially extended position.

Figures 2, 3:
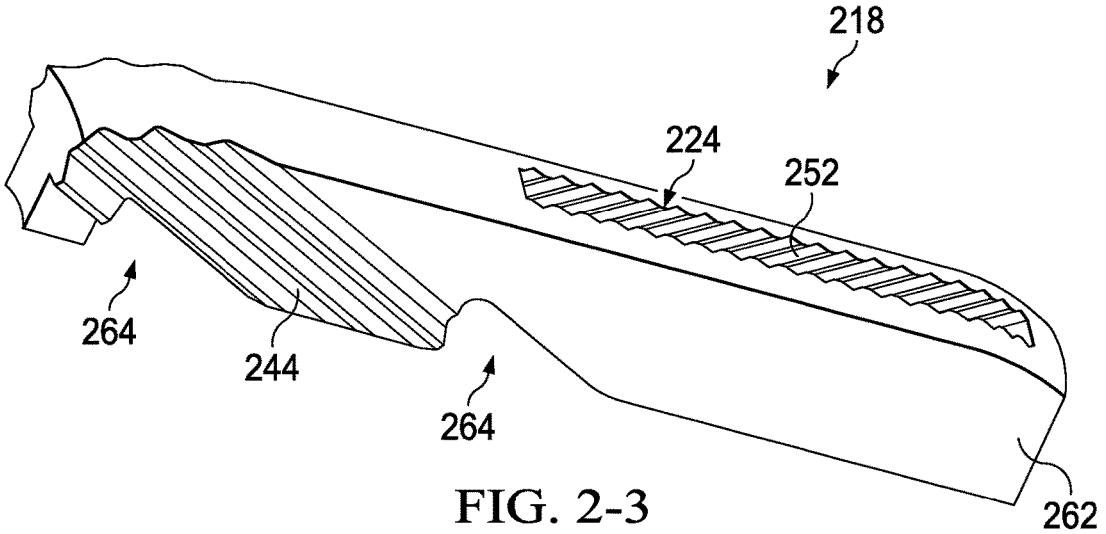

As shown in FIG. 2-3, the cutting block 218 may include a plurality of angled splines 244 formed on the lateral sides thereof. The splines 244 are sized and shaped to engage corresponding angled splines 246 formed on the lateral sides of the recess 220. Interconnection between the splines 244 and the splines 246 may increase the contact surface area between the cutting block 218 and the tool body 212, thereby providing a robust structure suitable for downhole casing milling and/or cement removal operations. The splines 244, 246 may be angled such that the splines 244, 246 are not parallel with a longitudinal or central axis of the downhole tool 200. As such, relative axial motion between the cutting block 218 and the tool body 212 may cause a corresponding radial extension or retraction of the cutting block 218. The splines 244, 246 may be angled such that the cutting block 218 may be radially extended via uphole axial motion of the cutting block 218 with respect to the tool body 212. The splines 244, 246 may be oriented at substantially any suitable angle. For instance, in some embodiments, the splines 244, 246 may be at an angle that is between 15° and 45° relative to the longitudinal axis of the downhole tool 200. By way of example, the splines 244, 246 may be oriented at an angle that is between 20° and 40° or between 25° and 35° relative to the longitudinal axis of the downhole tool 200. In other embodiments, the angle of the splines 244, 246 relative to the longitudinal axis of the downhole tool 200 may be less than 15° or greater than 45°.

The milling blade 222 may be positioned in the recess 224 in the cutting block 218. The recess 224 may be through approximately a center of the cutter block 218, although in other embodiments the recess 224 may be a cut-out on a lateral surface of the cutter bock 218 or eliminated entirely (e.g., where the milling blade 222 engages a lateral surface of the cutter block 218). The milling blade 222 may be coupled to the tool body 212 and/or the cutting block 218. In FIGS. 2-1 and 2-2, for instance, the milling blade 222 may include one or more angled splines 248 on one or more lateral surfaces of a body 250 of the milling blade 222. One or more corresponding angled splines 252 may be formed on internal, lateral surfaces of the cutting block 218 adjacent the recess 224 and sized and shaped to engage corresponding angled splines 248 formed on the milling blade 222. Interconnection between the splines 248 and the splines 252 provides a contact surface area between the milling blade 222 and the cutting block 218, thereby providing a robust structure suitable for downhole casing milling and/or cement removal operations. The splines 248, 252 may be angled such that the splines 248, 252 are not parallel with a longitudinal or central axis of the downhole tool 200, not parallel with the splines 244, 246, or not parallel to both the central axis of the downhole tool 200 and the splines 244, 246. As such, relative axial motion between the milling blade 222 and the cutting block 218 may cause a corresponding radial extension or retraction of the milling blade 222.

The splines 248, 252 may be angled such that the milling blade 222 may be radially extended via uphole axial motion of the milling blade 222 with respect to the cutting block 218. The splines 248, 252 may be oriented at substantially any suitable angle. For instance, in some embodiments, the splines 248, 252 may be at an angle that is between 45° and 135° relative to the splines 244, 246. By way of example, the splines 248, 252 may be oriented at an angle that is between 60° and 120° or between 75° and 105° relative to the splines 244, 246. In other embodiments, the angle of the splines 248, 252 relative to the splines 244, 246 may be less than 45° or greater than 135°, or measured relative to the longitudinal axis of the downhole tool 200. For instance, if the splines 244, 246 are oriented at a 30° angle relative to the longitudinal axis of the downhole tool 200, and the splines 248, 252 are at 90° angle relative to the splines 244, 246, the splines 248, 252 may be at a 120° angle relative to the longitudinal axis of the downhole tool 200.

The milling blade 222 may be coupled to the tool body 212. In particular, FIGS. 2-1 and 2-2 illustrate an example embodiment in which links 254 couple the milling blade 222 to the tool body 212. For instance, each link 254 may be coupled to the tool body 212 by a body pin 258, and to the milling blade 222 by a blade pin 260. The illustrated links 254 are axially offset from each other, but may be radially offset or both axially and radially offset from each other in some embodiments. Further, while two links 254 are shown, more or fewer links 254 may be used, or links of different sizes, positions, or configurations may be used.

In transitioning the downhole tool 200 from the retracted/inactive state shown in FIG. 2-1 to the expanded/active state shown in FIG. 2-2, the drive ring 228 may move the cutting block 218 axially as discussed herein. The engaged splines 244, 246 may cause the cutting block 218 to move radially outwardly. At the same time, the milling blade 222 may be fully or partially housed in the recess 224 in the cutting block 218 and may also move axially and radially. As the links 254 may remain coupled to the milling blade 218 and the tool body 212 (e.g., by virtue of the links 254 providing a fixed distance between the body pins 258 and the blade pins 260), the axial and radial movement of the milling blade 218 may cause the links 254 to rotate (e.g., counter-clockwise about the body pins 258 from the position in FIG. 2-1) around respective body pins 258. To maintain the body pins 258 and the blade pins 260 at the same distance, the splines 248 of the milling blade 222 may cooperate with the splines 252 of the cutting block 218 to move the milling blade 222 radially outward from the cutting block 218, as shown in FIG. 2-2. The length and position of the links 254 may therefore cooperate with the angle of the splines 248, 252 to allow or cause the milling blade 222 to be radially extended relative to the cutting block 218.

In the illustrated embodiment, the links 254 may be used to cause movement of the cutting block 218 (e.g., retraction or expansion) relative to the tool body 212 to automatically result in movement of the milling blade 222 (e.g., retraction or expansion through radial and/or axial movement) relative to the cutting block 218. Optionally, the body pins 258 may be in a fixed axial, radial, or circumferential position with respect to the tool body 212 defining the bore and in which the optional mandrel 225 is located, although in one or more other embodiments, the body pins 258 may move relative to the tool body 212 (e.g., by being coupled to a component that is movable within the tool body 212, or by being located within a recess or groove having an axial, radial, or circumferential path within the tool body 212). Similarly, the blade pins 260 may be in a fixed axial, radial, or circumferential position with respect to the milling blade 222, although in one or more other embodiments, the blade pins 260 may move relative to the milling blade 222 (e.g., within a recess or groove having an axial, radial, or circumferential/lateral path within the milling blade 222). In the illustrated embodiment, there is a relative radial and axial movement of the cutting block 218 relative to the body pins 258 and the blade pins 260.

FIG. 2-3 illustrates the cutting block 218 of FIGS. 2-1 and 2-2 in additional detail. As shown, a block body 262 optionally includes one or more groove, slots, cut-outs, or other surface features 264. Such surface features 264 may be shaped, sized, and positioned to correspond to, and potentially accommodate or house, the links 254 shown in FIGS. 2-1 and 2-2. For instance, when the links 254 are in a position corresponding to a retracted cutting block 218 and milling blade 222 (FIG. 2-1) or when in a position corresponding to an expanded cutting block 218 and milling blade 222 (FIG. 2-2), the links 254 may be fully or partially located within one or more surface features 264. For instance, the links 254 may at least partially be located within the surface features 264 to fit within the profile of the cutting block 218 (e.g., not extend radially or axially outside the profile of the cutting block 218) while the cutting block 218 and milling blade 222 are retracted (see FIG. 2-1) or expanded. The surface features 264 may extend into or through a lateral or side surface of the body 262 of the cutting block 218 (e.g., a surface in which an external spline 244 is formed), as shown in FIG. 2-3; however, in the same or other embodiments surface features may be located in other lateral surfaces, bottom surfaces (e.g., a surface facing the mandrel 225 to toward an axis of the tool body 212), other surfaces, or combinations of the foregoing.

Figures 2, 3, 4:
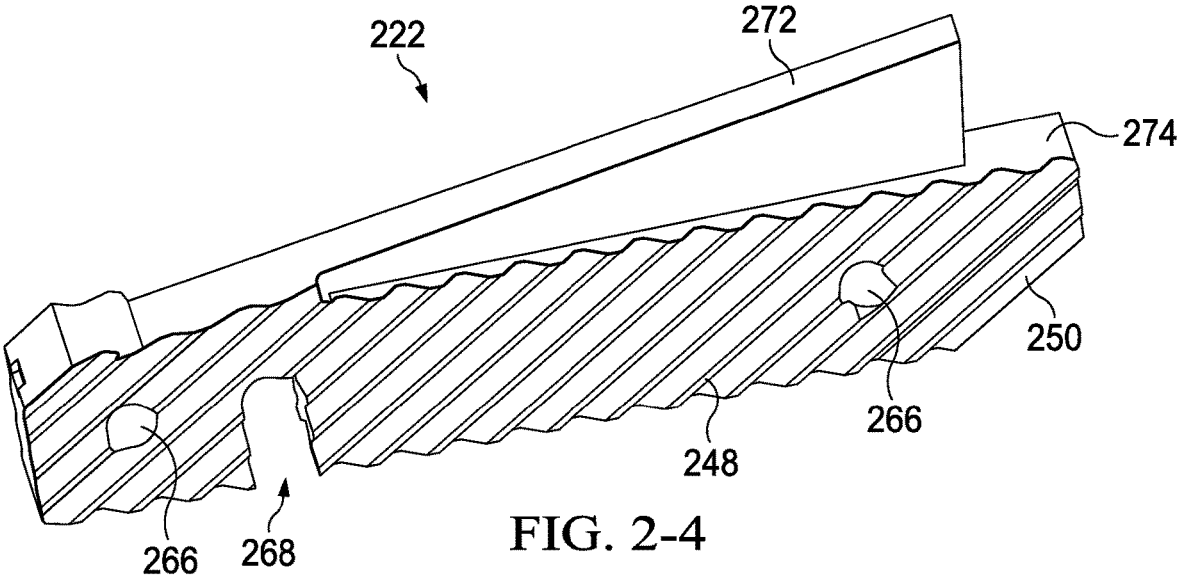
Figures 1, 3:
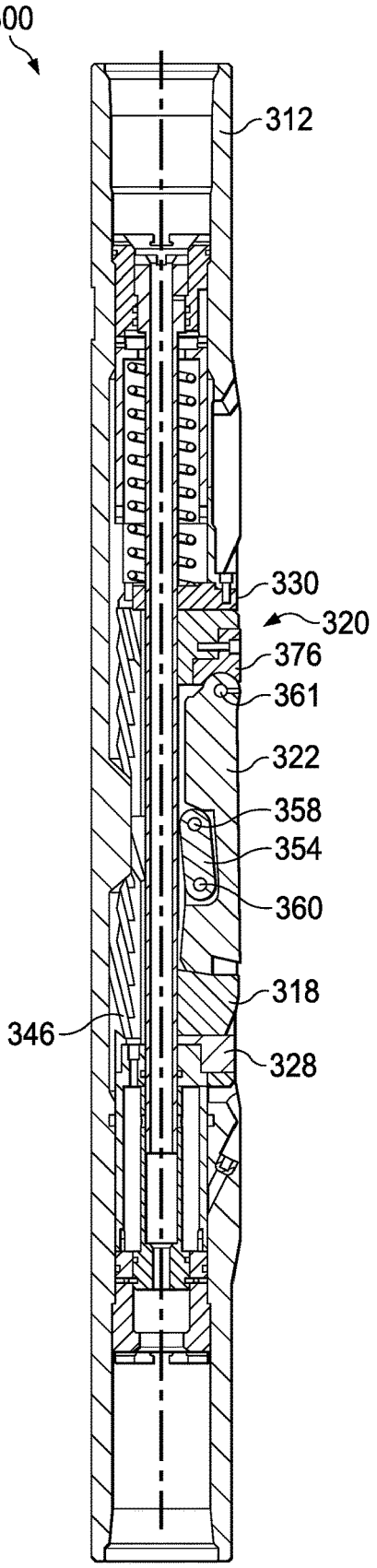
Figures 2, 3:
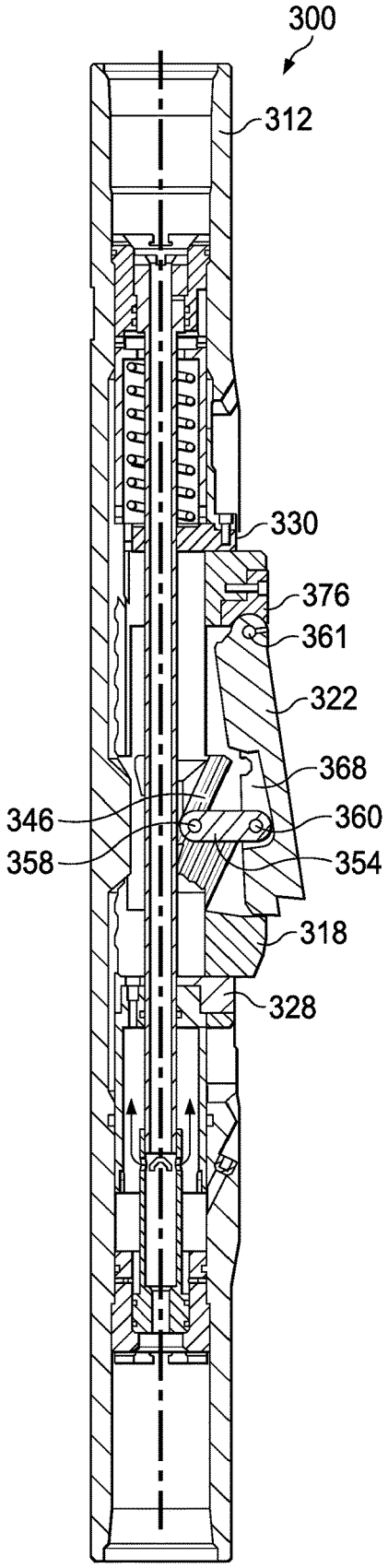
Figure 3:
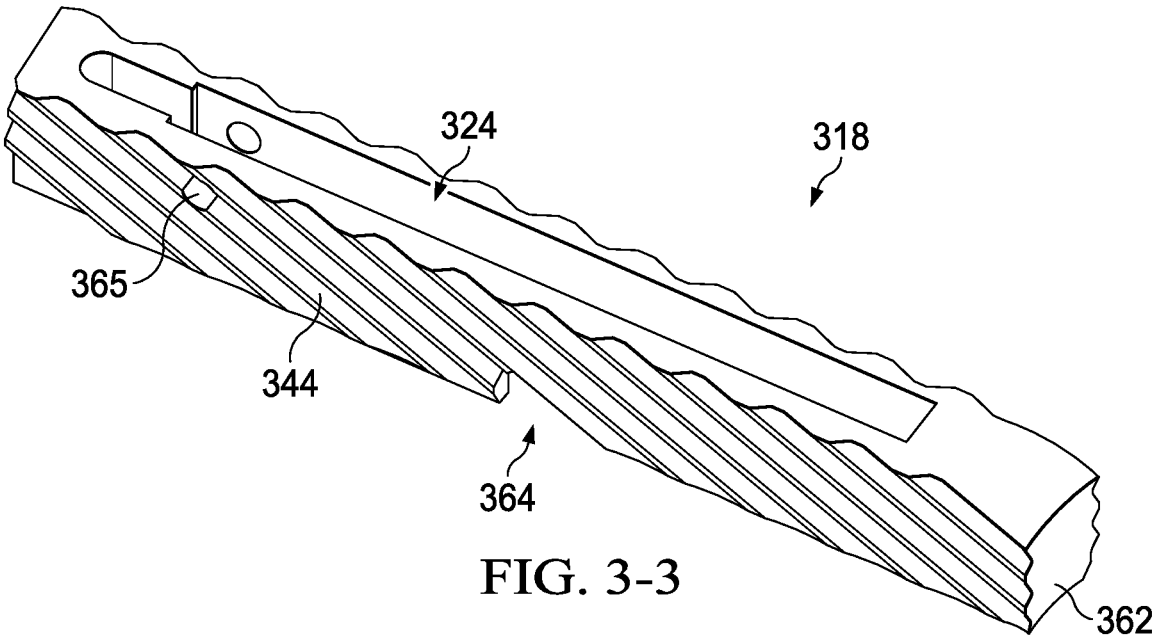
Figures 3, 4:
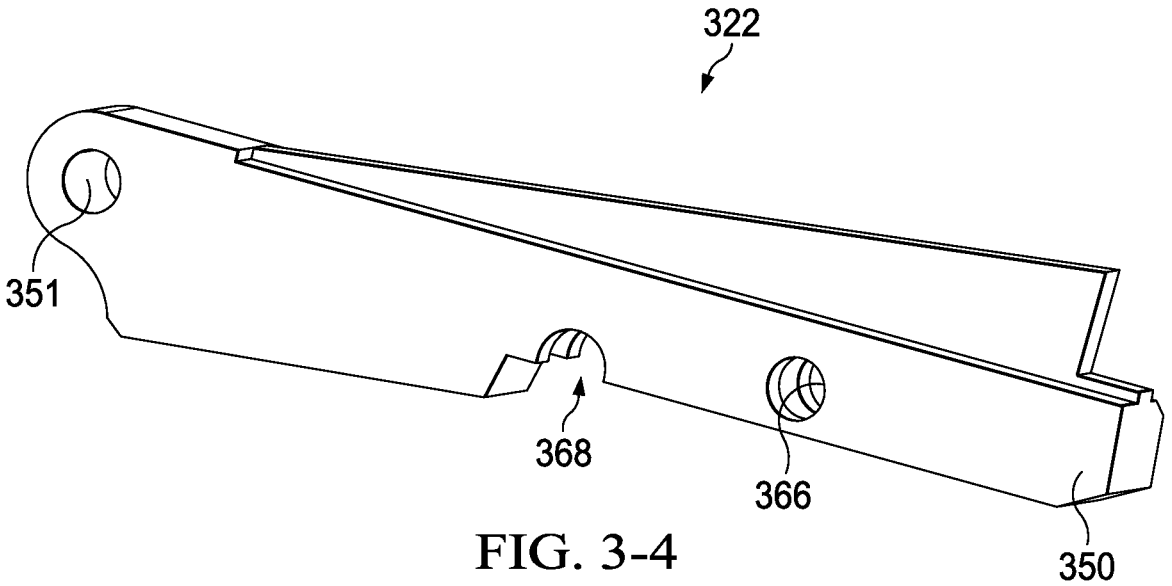
Figures 1, 4:
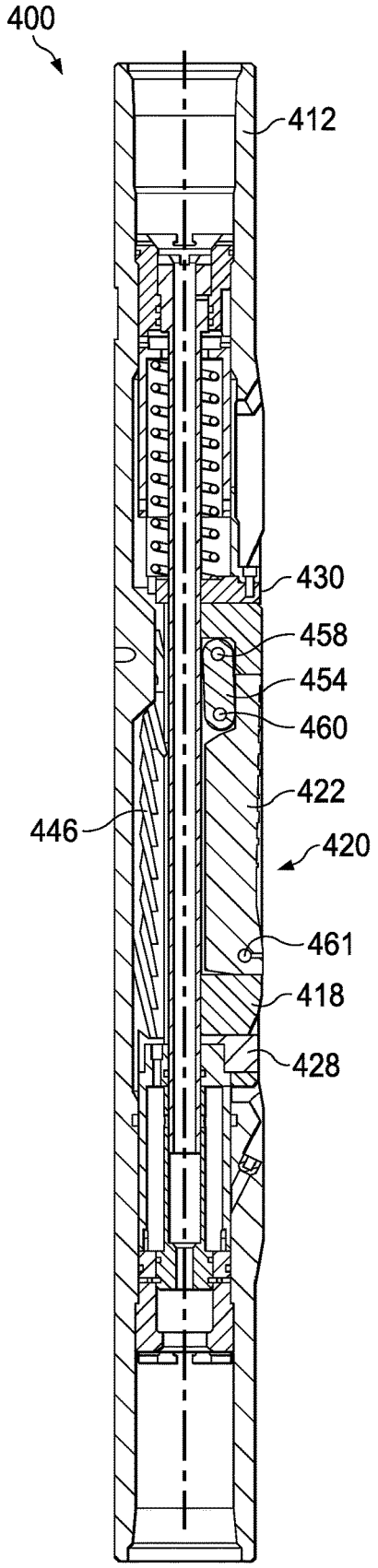
Figures 2, 4:
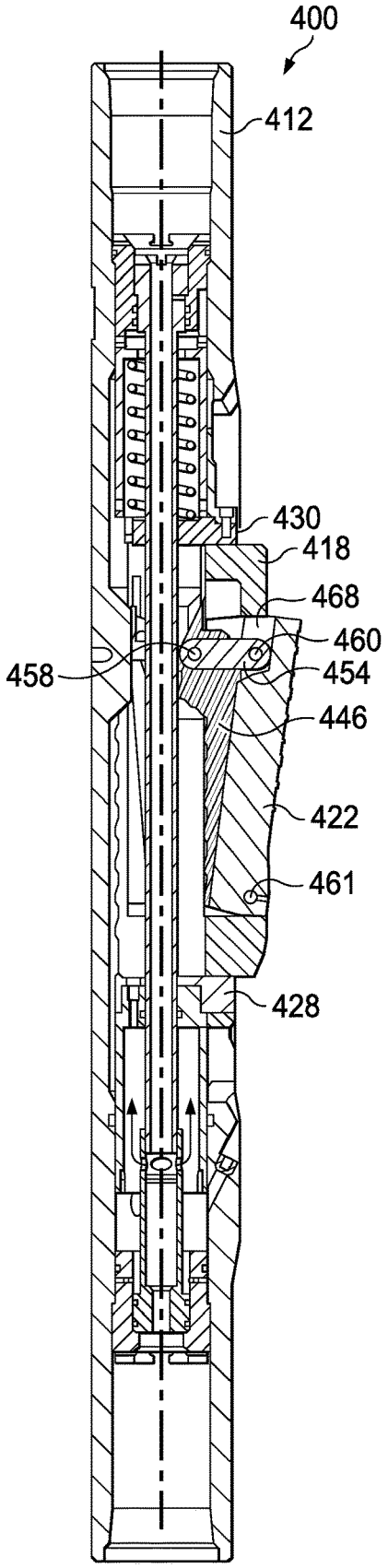
Figures 3, 4:
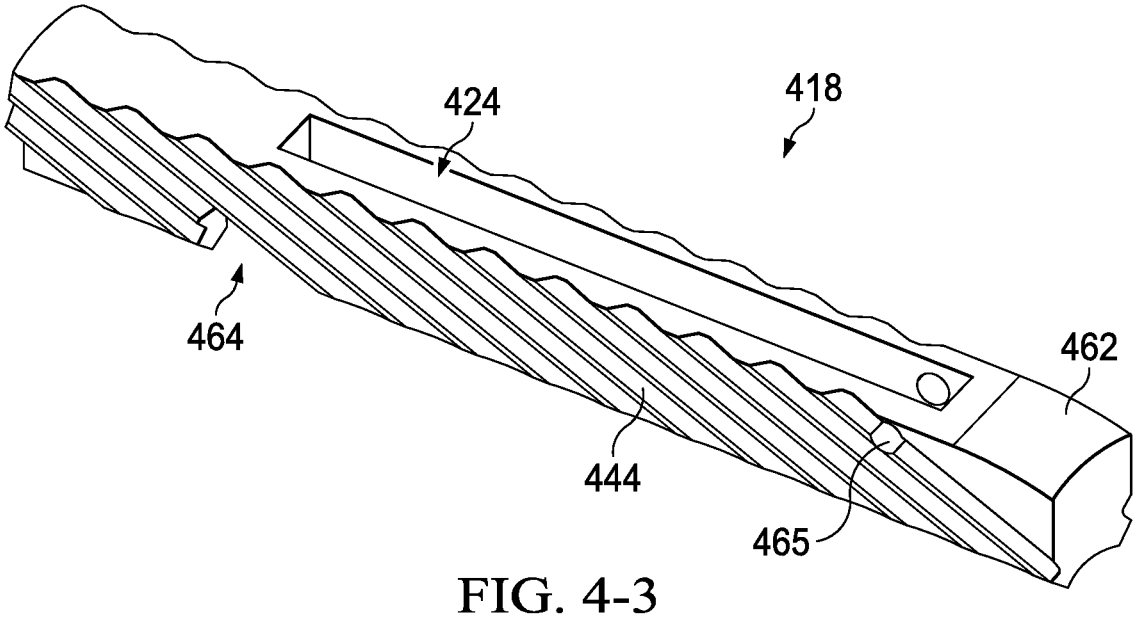
Figure 4:
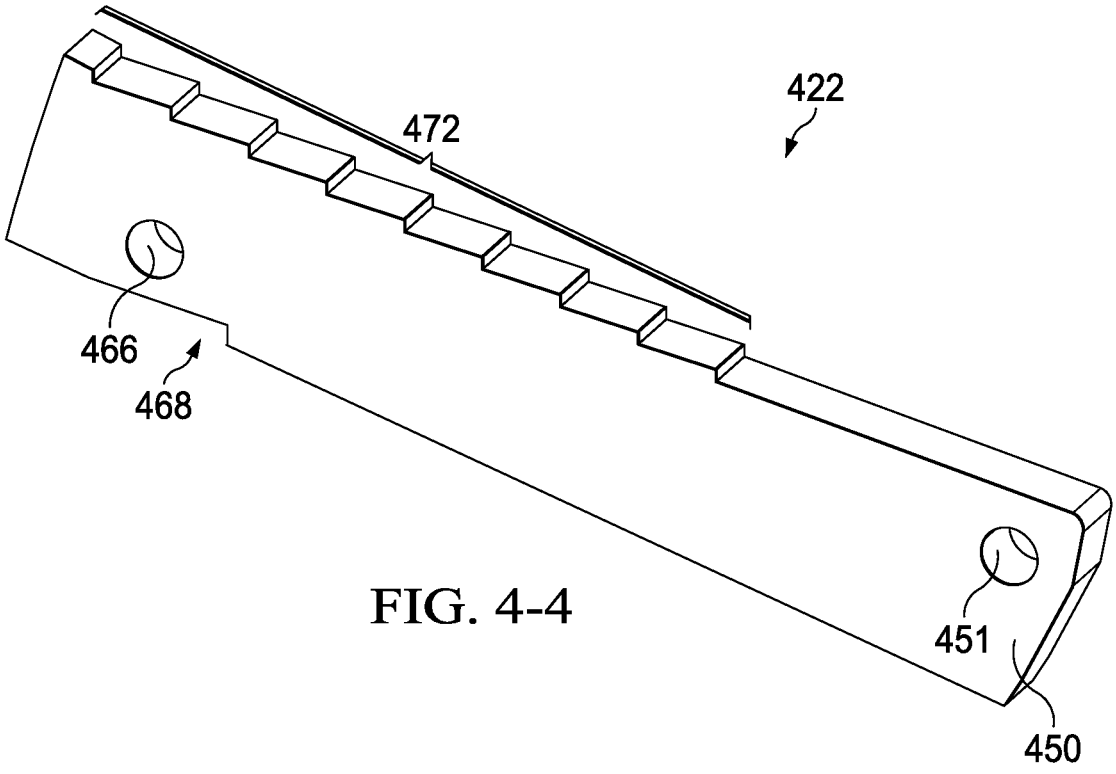

A milling blade 222 that may be used with the cutting block 218 of FIG. 2-3 is shown in FIG. 2-4. In this embodiment, the body 250 of the milling blade 222 is shown as having the angled splines 248 on at least one lateral side (although they may also or otherwise be located on the opposing lateral side). The body 250 also defines two openings 266, which may receive one or more pins (e.g., blade pins 260) coupled to one or more links (e.g., links 254). One or more grooves, slots, cut-outs, or other surface features 268 may also be formed in the body 250 of the milling blade 222 to fully or partially enclose a link 254 when the milling blade 222 is in a radially expanded or retracted position. For instance, the surface feature 268 may enclose an uphole end portion of a lower, or second link 254 when the downhole tool 200 is in a retracted/inactive position as shown in FIG. 201. In some embodiments, a surface feature 268 may extend into a lateral/side surface of the body 250. In the same or other embodiments, a surface feature 268 may extend axially along a bottom or other surface of the body 250.

In the example embodiment depicted in FIGS. 2-1 to 2-4 at least a nose portion 270 of the cutting block 218 may extend radially from the tool body 212 (e.g., when the downhole tool 200 is in an expanded/active position). In some embodiments, the nose portion 270 may have one or more cutting elements coupled thereto. Any cutting elements suitable for milling casing, removing cement, or removing/reaming formation may be utilized. Such cutting elements include, but are not limited to, polycrystalline diamond cutter (PDC) inserts, thermally stabilized polycrystalline (TSP) inserts, diamond inserts, boron nitride inserts, abrasive materials, tungsten carbide inserts, hardfacing, chunky carbide, other cutting elements, and combinations of the foregoing. The cutting block 218 may further include various wear protection measures deployed thereon, for example, including the use of wear buttons, hard facing materials, or various other wear resistant coatings or components. The cutting block 218 may be considered a "cutting" block even in the absence of cutting elements or features facilitating a cutting action by the cutting block 218.

A cutting knife or other milling element 272 of the milling blade 222 may be dressed using any known cutting or other materials in the art. For example, one or more surfaces of the milling element 272 may be substantially or heavily hardfaced with a metallurgically-applied tungsten carbide material. Other surface treatments may include, for example, disposition of a diamond or cubic boron nitride material, disposition of an embedded natural or polycrystalline diamond, brazing of cutting inserts thereto, or the like. Other suitable surface treatments may be equally employed. In some embodiments, at least a stabilizing portion 274 of the milling blade 222 may extend radially from the cutting block 218. In some embodiments, the stabilizing portion 274 may be one or more of downhole relative to milling element 272, uphole relative to the milling element 272, of a greater width than the milling element 272, or have a reduced radial extension relative to the milling element 272. The stabilizing portion 272 may have one or more cutting elements or gauge protection elements coupled thereto for milling casing, removing cement, removing formation, providing wear protection measures, or a combination of the foregoing.

As discussed herein, the milling blades 222 may be configured to move between radially retracted (see FIG. 2-1) and radially extended positions (see FIG. 2B). With the milling blades 222 extended, the downhole tool 200 may be used in a milling operation and rotated to initiate a cut-out in a casing string and then moved in a downhole direction. Such rotational and translational movement may allow a downhole end portion (e.g., cutting elements on the milling element 272) to mill away a section of a casing string. When milling the casing string, the radial and/or axial load on the milling blade 222 and/or the cutting block 218 may be on one or more of the splines 244, 246, 248, 252, rather than on the links 254. In some embodiments, the links 254 may bear some of the load occurring during a milling operation.

In the discussion herein, the radially retracted and extended positions of the milling blades 222 are generally described with reference to the cutting blocks 218. The position of the milling blades 222 could, however, also be described in reference to the tool body 212. For instance, in FIG. 2-1, the milling blade 222 may be in radially retracted position relative to the tool body 212. In FIG. 2-2, the milling blade 222 may be in a radially expanded position relative to the tool body 212. Although not illustrated, some embodiments contemplate the milling blade 222 moving independently of the cutting block 218, or otherwise moving to allow the milling blade 222 to have an intermediate, radially expanded position relative to the tool body 212. In such an intermediate position, the cutting block 218 could be expanded relative to the tool body 212, but the milling blade 222 could be at least partially housed within and remain radially retracted relative to the cutting block 218, or the milling blade 222 could be expanded relative to the cutting block 218 and the cutting block 218 could be retracted relative to the tool body 212. The milling blade 222 could therefore be radially extended to about the same radial position of the cutting block 218 in FIG. 2-2. In still other embodiments, one or more additional intermediate positions may be obtained for the cutting block 218 and/or the milling blade 222.

The embodiment described relative to FIGS. 2-1 to 2-4 is illustrative, and other embodiments contemplate other arrangements of components, features, or operations. For instance, rather than a piston 226 and/or drive ring 228 moving a cutting block 218 in an uphole direction to radially expand the cutting block 218 and/or the milling blade 222, a piston 226 and/or drive ring 228 may move a cutting block 218 in a downhole direction. Similarly, a bias mechanism such as spring 232 may bias the cutting block 218 toward an uphole position and/or toward a radially expanded position rather than a downhole and radially retracted position. Additionally, the milling blade 218 may be configured to mill by moving the downhole tool 200 in an uphole direction rather than a downhole direction. Further, while the milling blade 222 is shown as being movable in radial and axial directions relative to the cutting block 218, in other embodiments the milling blade 222 may move radially but not axially relative to the cutting block 218 (e.g., may rotate rather than translate). In still other embodiments, rather than using a piston 226 and drive ring 228, direct engagement of the fluid on the cutting block 218 may move the cutting block 218 toward a radially expanded position. In such embodiments, the mandrel 225 may be eliminated or an actuator may flow fluid to a chamber in direct contact with the cutting blocks 218 rather than to a piston chamber.

Turning now to FIGS. 3-1 and 3-2, another example embodiment of a downhole tool 300 is shown and described in some detail. FIGS. 3-3 and 3-4 illustrate example embodiments of a cutting block 318 and milling blade 322 usable with the downhole tool 300. The cutting block 318 and milling blade 322 of the downhole tool 300 may be selectively activated and moved between radially retracted (see FIG. 3-1) and radially extended (see FIG. 3-2) positions. Activation of the downhole tool 300 may occur in any number of manners, including in manners similar to, or the same as, those discussed herein with respect to the downhole tool of FIGS. 2-1 and 2-2. Accordingly, to simplify the discussion, some activation components, actuators, and other components of the downhole tool 300 will not be described in additional detail, and will be apparent to one skilled in the art in view of the disclosure herein.

As shown in FIGS. 3-1 and 3-2, the milling blade 322 may be radially movable relative to a tool body 312 of the downhole tool 300, as well as relative to the cutting block 318. In this embodiment, for instance, the cutting block 318 may located at least partially inside a recess 320 formed radially within an outer wall of the tool body 312, and may include one or more angled splines 344 that engage with one or more angled splines 346 on lateral surfaces of the tool body 312, and which are adjacent the recess 320. As the cutting block 318 moves axially relative to the tool body 312 (e.g., in response to movement of a drive ring 328 or stop ring 330), the splines 344, 346 may cause the cutting block 318 to move radially. The splines 344, 346 may operate in a manner similar to the splines 244, 246 described with respect to FIGS. 2-1 to 2-3.

The milling blade 322 may be coupled to the tool body 312 and/or the cutting block 318 in a manner that also allows the milling blade 322 to move radially relative to the cutting block 318. For instance, one or more links 354 may be coupled to the tool body 312 (e.g., using a body pin 358) and to the milling blade 322 (e.g., using a blade pin 360). As the cutting block 318 moves along an angle and radially outward from the tool body 312, the blade pin 360 may move axially and radially uphole relative to the tool body 312, while the body pin 358 remains at a fixed location relative to the tool body 312 (or within a defined groove or path in or relative to the tool body 312). The link 354 may have a fixed length. Thus, as cutting block 318 carrying or housing the milling blade 322 moves, the link 354 may cause the milling blade 322 to move radially relative to the cutting block 318 and the tool body 312. For instance, the milling blade 322 may also be fixed or otherwise coupled to the cutting block 318 at one or more locations. In FIGS. 3-1 and 3-2, for instance, a block pin 361 at an upper end portion of the milling blade 322 may couple the milling blade 322 to the cutting block 318. As a result, as the cutting block 318 moves axially and radially relative to the tool body 312, the length of the link 354 may cause the link 354 to pivot about the body pin 358 (e.g., counterclockwise from the position in FIG. 3-1) and the milling blade 322 to pivot (e.g., counterclockwise from the position in FIG. 3-1) about the block pin 361. The downhole end portion of the cutting block 318 may then move radially outward relative to the cutting block 318 toward the position shown in FIG. 3-2. The downhole tool 300 may then be rotated and/or moved in a downhole direction to mill a casing string or perform another milling, reaming, or other cutting operation. To retract the milling blade 322 to the position shown in FIG. 3-1, the cutting block 318 may be moved in a downhole direction along the splines 346, which may also cause the link 346 to rotate about the body pin 358 (e.g., clockwise from the position in FIG. 3-2), and the milling blade 322 to pivot about the block pin 361 (e.g., clockwise from the position in FIG. 3-2). In some embodiments, upward movement of the downhole tool 300 may also help push the milling blade 322 and/or the cutting block 318 downward to assist in retracting the milling blade 322 and the cutting block 318.

As will be appreciated in view of the disclosure herein, the milling blade 322 may be selectively activated, which may include moving the milling blade 322 radially by rotating the milling blade 322. Such rotation may occur without moving the milling blade 322 axially relative to the cutting block 318. During such activation, the milling blade 322 may move both radially and axially relative to the tool body 312. When used while the milling blade 322 is in the radially expanded position of FIG. 3-2, the radial and/or axial forces applied to the milling blade 322 may be borne by the link 354. In some embodiments, however, the milling blade 322 may transfer at least some of such forces to the cutting block 318 or to one or more other components. In FIGS. 3-1 and 3-2, for instance, a lug 376 is shown as being coupled to an upper end portion of the cutting block 318, and adjacent the upper end portion of the milling blade 322 and/or the block pin 361. The milling blade 322 may contact the lug 376 at least when in a radially extended position. As a result, forces applied to the milling blade 322 may be at least partially transferred to the lug 376. The lug 376 may be configured to absorb such forces. In some embodiments, the lug 376 may be a sacrificial or replaceable element configured to deform or fail in order to reduce damage to the milling blade 322, the cutting block 318, the link 354, or the pins 358, 360, 361. One or more connectors (e.g., bolts, clamps, etc.) may be used, in some embodiments, to couple the lug 376 to the cutting block 318 or another component. In other embodiments, the lung 376 may be integrally formed as a monolithic portion of the cutting block 318.

FIG. 3-3 illustrates the cutting block 318 of FIGS. 3-1 and 3-2 in additional detail. As shown, a block body 362 may include a cut-out or recess 324. The recess 324 may extend radially and/or axially through or along at least a portion of the block body 362 and be configured to receive a milling knife 322 (see FIG. 3-4) therein. Optionally, a lug (e.g., lug 376) may also be positioned in a portion of the recess 324.

In some embodiments, an opening 365 may be formed in the block body 362 and configured to receive a block pin 361 (see FIG. 3-1). Further, in some embodiments, the block body 362 optionally includes one or more groove, slots, cut-outs, or other surface features 364 shaped, sized, or positioned to correspond to (e.g., fully or partially receive or house) the link 354 shown in FIGS. 3-1 and 3-2, when such link 354 is in a retracted or extended position. The surface features 364 may extend into a lateral surface of the body 362 as shown in FIG. 3-3; however, in the same or other embodiments surface features may be located in other lateral surfaces, bottom surfaces, other surfaces, or combinations of the foregoing.

A milling blade 322 that may be used with the cutting block 318 of FIG. 3-3 is shown in FIG. 3-4. In the illustrated embodiment, the body 350 of the milling blade 322 may or may not have splines (and there may or may not be splines adjacent the recess 324 in the cutting block 218 of FIG. 3-3). Where splines are included, the splines may be curved rather than linear and angled as shown in FIGS. 2-1 to 2-4 to allow the milling blade 322 to rotate around a block pin in a pin opening 351 in the body 350 of the milling blade 322. The body 350 may also define one or more openings 366, which may receive one or more pins (e.g., blade pins 360) coupled to one or more links (e.g., links 354). One or more grooves, slots, cut-outs, or other surface features 368 may also be formed axially, radially, or both axially and radially in the body 350 of the milling blade 322 to fully or partially enclose a link 354 when the milling blade 322 is in a radially expanded or retracted position. In some embodiments, a surface feature 368 may extend into a lateral surface of the body 350. In the same or other embodiments, a surface feature 368 may extend axially along a bottom or other surface of the body 350. In some embodiments, a surface feature 368 may extend across a full or partial width of the body 350.

Turning now to FIGS. 4-1 and 4-2, another example embodiment of a downhole tool 400 is shown and described in some detail. FIGS. 4-3 and 4-4 illustrate example embodiments of a cutting block 418 and milling blade 422 usable with the downhole tool 400. The cutting block 418 and milling blade 422 of the downhole tool 400 may be selectively activated (together or independently) and moved between radially retracted (see FIG. 4-1) and radially extended (see FIG. 4-2) positions. Activation of the downhole tool 400 may occur in any number of manners, including in manners similar or the same as those discussed herein with respect to the downhole tools of FIGS. 2-1 and 2-2 and FIGS. 3-1 and 3-2. Accordingly, to simplify the discussion, some components and features of the downhole tool 400 will not be described in additional detail, but will be apparent to one skilled in the art in view of the disclosure herein.

As shown in FIGS. 4-1 and 4-2, the milling blade 422 may be radially movable relative to a tool body 412 of the downhole tool 400, as well as relative to the cutting block 418. In this embodiment, for instance, the cutting block 418 may located at least partially inside a recess 420 in the tool body 412 and may include one or more angled splines 444 that engage with one or more angled splines 446 on lateral surfaces adjacent the recess 420. As the cutting block 418 moves axially relative to the tool body 412 (e.g., in response to movement of a drive ring 428 or stop ring 430), the engagement between the splines 444, 446 may cause the cutting block 418 to move radially (e.g., at an angle relative to a line perpendicular to the longitudinal axis of the downhole tool 400). The splines 444, 446 may operate in a manner similar to the splines 244, 246 described with respect to FIGS. 2-1 to 2-3 and the splines 344, 346 described with respect to FIGS. 3-1 to 3-3.

The milling blade 422 may be coupled to the tool body 412 and/or the cutting block 418 in a manner that also allows the milling blade 422 to move radially relative to the cutting block 418. For instance, a link 454 may be coupled to the tool body 412 (e.g., using a body pin 458) and to the milling blade 422 (e.g., using a blade pin 460). As the cutting block 418 moves along an angle and radially outward from the tool body 412, the blade pin 460 may move axially and radially uphole, while the body pin 458 remains at a fixed location on the tool body 412. The link 454 may have a fixed length, and such length may be configured to cause the milling blade 422 to move radially relative to the cutting block 418. For instance, the milling blade 422 may also be fixed or otherwise coupled to the cutting block 418 at one or more locations. In FIGS. 4-1 and 4-2, for instance, a block pin 461 at a downhole end portion of the milling blade 422 may couple the milling blade 422 to the cutting block 418. As a result, as the cutting block 418 moves axially and radially relative to the tool body 412, the length of the link 454 may rotate (e.g., counterclockwise from the position in FIG. 4-1) about the body pin 458 and cause the milling blade 422 to pivot about the block pin 461 (e.g., clockwise from the position in FIG. 4-1). The uphole end portion of the cutting block 418 may then move radially outward relative to the cutting block 418 to the position shown in FIG. 4-2. The downhole tool 400 may then be rotated and/or moved in a downhole direction to mill a casing string. To retract the milling blade 422 to the position shown in FIG. 4-1, the cutting block 418 may be moved in a downhole direction along the splines 446, which may also cause the link 446 to rotate (e.g., clockwise from the position in FIG. 4-2) about the body pin 458 and the milling blade 422 to pivot about the block pin 461 (e.g., counterclockwise from the position in FIG. 4-2).

As will be appreciated in view of the disclosure herein, the milling blade 422 may be selectively activated, which may include moving the milling blade 422 radially relative to the cutting block 418 by rotating the milling blade 422. Such rotation may occur without moving the milling blade 422 axially relative to the cutting block 418. During such activation, the milling blade 422 may move both radially and axially relative to the tool body 412. When used while the milling blade 422 is in the radially expanded position of FIG. 4-2, the radial and/or axial forces applied to the milling blade 422 may be borne by the link 454. In some embodiments, however, the milling blade 422 may transfer at least some of such forces to the cutting block 418 which may be in contact with an uphole or downhole end portion of the milling blade 422.

FIG. 4-3 illustrates the cutting block 418 of FIGS. 4-1 and 4-2 in additional detail. As shown, a block body 462 may include a cut-out or recess 424. The recess 424 may extend radially and/or axially through or along at least a portion of the block body 462 and be configured to receive a milling knife 422 (see FIG. 4-4) therein.

In some embodiments, an opening 465 may be formed in the block body 462 and configured to receive a block pin 461 (see FIG. 4-1). Further, in some embodiments, the block body 462 optionally includes one or more groove, slots, cut-outs, or other surface features 464 shaped, sized, and positioned to correspond to the link 454 shown in FIGS. 4-1 and 4-2, when such link 454 is in a retracted or extended position. The surface features 464 may extend into a lateral surface of the body 462 as shown in FIG. 4-3; however, in the same or other embodiments surface features may be located in other lateral surfaces, bottom surfaces, other surfaces, or combinations of the foregoing.

A milling blade 422 that may be used with the cutting block 418 of FIG. 4-3 is shown in FIG. 4-4. In the illustrated embodiment, the body 450 of the milling blade 422 may or may not have splines, as discussed herein. For instance, similar to the embodiment shown in FIGS. 3-1 to 3-4, the splines may be curved rather than linear to allow the milling blade 422 to rotate around a block pin in a pin opening 451 in the body 450 of the milling blade 422. The body 450 may also define one or more openings 466, which may receive one or more pins (e.g., blade pins 460) coupled to one or more links (e.g., links 454). One or more grooves, slots, cut-outs, or other surface features 468 may also be formed in the body 450 of the milling blade 422 to fully or partially enclose a link 454 when the milling blade 422 is in a radially expanded or retracted position. In some embodiments, a surface feature 468 may extend into a lateral surface of the body 450. In the same or other embodiments, a surface feature 468 may extend axially along a bottom or other surface of the body 450.

The downhole tool 400 may operate in a manner similar to that described for other embodiments herein. As a result, when the cutting block 418 and the milling blade 422 are in radially expanded positions, the downhole tool 400 may be rotated and moved in a downhole direction to mill-out a section of casing. For the downhole tools 200 and 300, corresponding milling knives 222 and 322 may include milling elements with relatively blunt downhole end portions. In contrast, the milling blade 422 is shown as including a milling element 472 that is optionally tapered to gradually cut the casing string or other downhole element. More particularly, when the milling blade 422 is in a radially expanded position, the milling element 472 may be angled such that the upper end portion of the milling blade 422 is radially farther from a longitudinal axis of the downhole tool 400 than is a downhole end portion of the milling blade 422. Thus, as the downhole tool 400 and the milling blade 422 move in a downhole direction, the milling element 472 will begin to cut the casing string at a portion of the milling element 472 having a radial distance less than the full radial position of the milling blade 422. Further downhole movement of the milling blade 422 will then cause the uphole portions of the milling element 472 to engage the casing string, and the tapered milling element 472 to mill the casing string at increasing radial distances from the longitudinal axis of the downhole tool 400.

The milling element 472 may be tapered in any suitable manner, including a linear, arcuate, parabolic, or other manner. In some embodiments, the milling element 472 may include multiple steps or tiers so that the taper is a step-wise taper. Each step or tier of the milling element 472 may include one or more cutting elements or wear protection elements as discussed herein. In at least some embodiments, the step-wise taper may provide a stabilizing effect to reduce vibration as the downhole tool 400 performs a milling or other cutting operation. In other embodiments, the milling element 472 may not be tapered but may have a blunt cutting edge portion. In still other embodiments, a step-wise taper may have equal or unequal steps in terms of axial step length of the different steps, or radial distances between steps. In some embodiments, there may be between a 0.25 cm and 2.5 cm radial distance between the outer surfaces of any or each set of adjacent steps. In other embodiments, the radial separation may be less than 0.25 cm or greater than 2.5 cm. In the same or other embodiments, the axial length of any or each of the steps may be between 0.5 cm and 30 cm. In other embodiments, the axial length of a step may be less than 0.5 cm or greater than 30 cm.

Figure 5:
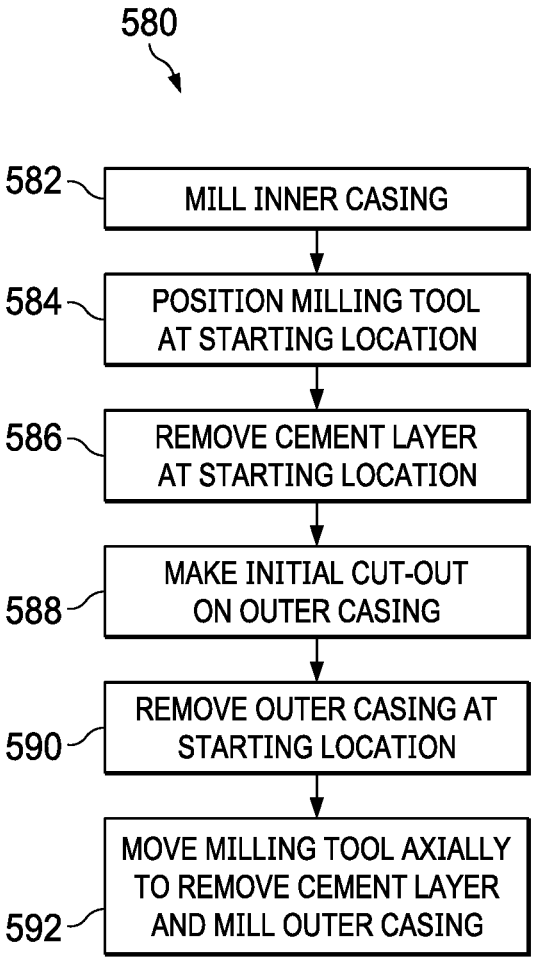
FIG. 5 is a flow chart of an example method in accordance with some embodiments of the present disclosure.

While not limited in this regard, milling tools 100, 200, 300, and 400 of the present disclosure may be used for single or dual-string milling operations. In the case of a dual-string milling operation, the milling tools may remove the multiple strings simultaneously, or may extend through a gap in a previously removed inner casing to mill an outer casing. FIG. 5 is a flow chart of one example method 580 for performing a dual-string section milling operation. The example method 580 depicted includes milling a length of a dual-string wellbore including removing portions of the inner and outer casing strings and an annular cement layer located between the casing strings. In the example embodiment depicted, the inner casing string is milled at 582 (e.g., with a conventional section mill, with a dual-casing section mill, etc.). After or during removal of the inner casing string, a milling tool (e.g., downhole tool 100, 200, 300, 400) may be used at 586 to remove an annular cement layer between the inner and outer casing strings. In some embodiments, the same or a different milling tool may be positioned (or re-positioned) at a starting location at 584 to mill the cement. In some embodiments, during or after milling the inner casing at 582 and/or the cement layer at 586, the milling tool may mill the outer casing string. Positioning the milling tool at 584 may in other embodiments be performed after or during milling the cement at 586. The starting location can be at or toward the uphole end portion of the wellbore section to be milled (e.g., for a milling tool that mills in a downhole direction), the downhole end portion of the wellbore section to be milled (e.g., for a milling tool that mills in an uphole direction), or anywhere between the uphole and downhole sections to be milled. Cutting blocks 218, 318, 418 and milling blades 222, 322, 422 are optionally in a retracted or substantially retracted position (as depicted in FIGS. 1, 2-1, 3-1, and 4-1) while the tool is positioned at 584.

The milling tool may be activated (e.g., by extending cutting blocks and/or milling blades into contact with a cement layer or inner or outer casing string) while or before the milling tool rotates in the wellbore. As or after the cement layer is removed at 586, the cutting blocks and milling blades may continue to extend radially, and a milling element of the milling blades may make an initial cut in the outer casing string at 588. A section of the outer casing string is then substantially fully removed at the starting location at 590 by the milling blades 222, 322, 422. After removal of the cement layer and the outer casing string at the starting location, the tool string is then moved axially (while rotating and with the cutting blocks and milling blades extended) so as to simultaneously remove the cement layer and to mill an axial length of the outer casing string at 592. During the milling operation, a nose portion of the cutting block may lead the milling blade downhole or uphole. Such deployment may provide for dual milling functionality in which the cutting block removes at least a portion of the cement layer or inner casing while the milling blade may simultaneously mill the outer casing string. This deployment may also minimize or reduce loading on the milling blade.

The milling tool may remove the casing by using a blunt or tapered milling element. For instance, a milling blade may expand radially and have a triangular or angled milling element that is wider at the downhole end portion than at an uphole end portion, or that is more radially outward at a downhole end portion that at an uphole end portion. The bottom surface of the triangular milling element (or cutting elements thereon) may engage the casing as the outer casing string is milled at 592. The triangular milling element may be part of a milling blade that extends radially from the cutting block using one or more links coupled to the downhole tool body and/or one or more pins coupled to the cutting block. In another embodiment, a milling element may be triangular or tapered such that a top surface of the milling element is wider than a downhole end portion of the milling element, or the uphole end portion may be radially outward of the downhole end portion. By moving the downhole tool in a downward direction, a tapered or angled portion of the milling element (or cutting elements thereon) may engage and mill the outer casing string at 592 rather than a blunt end of the milling element. While embodiments of the present disclosure may be used to mill in a downward direction, one skilled in the art will appreciate in view of the disclosure herein that features may be reversed or reconfigured to create a tool for milling in an upward direction. Additionally, while embodiments are disclosed herein with respect to milling casing, the embodiments disclosed herein may also be used or modified for use in other downhole operations, such as reaming, casing/pipe cutting, or other operations. In some embodiments.

According to one or more aspects, a downhole tool or a milling tool includes a tool body, a block that selectively expands and retracts relative to the tool body, and a blade that selectively expands and retracts relative to the tool body, the block, or both.

According to an aspect that may be combined with any one or more other aspects herein, one or more links may couple the blade to the tool body.

According to an aspect that may be combined with any one or more other aspects herein, a blade may be a milling blade configured to mill casing.

According to an aspect that may be combined with any one or more other aspects herein, a link may be pinned at a fixed location on the tool body.

According to an aspect that may be combined with any one or more other aspects herein, a link may be pinned at a fixed location on the blade.

According to an aspect that may be combined with any one or more other aspects herein, two or more links may couple the tool body to the blade.

According to an aspect that may be combined with any one or more other aspects herein, the blade may be within a recess in the block.

According to an aspect that may be combined with any one or more other aspects herein, the blade may be pivotally coupled to the block.

According to an aspect that may be combined with any one or more other aspects herein, the blade radially expands by moving radially and axially relative to the block.

According to an aspect that may be combined with any one or more other aspects herein, the blade radially expands by pivoting relative to the block.

According to an aspect that may be combined with any one or more other aspects herein, at least one link rotates about a body pin while the blade radially expands.

According to an aspect that may be combined with any one or more other aspects herein, a blade expands by a link rotating about a body pin in a same direction (e.g., clockwise or counterclockwise) as compared to a blade rotating about a block pin.

According to an aspect that may be combined with any one or more other aspects herein, a blade expands by a link rotating about a body pin in a different direction (e.g., clockwise or counterclockwise) as compared to a blade rotating about a block pin.

According to an aspect that may be combined with any one or more other aspects herein, a blade includes a cut-out or other feature in which a link is at least partially located while the blade is in a retracted position but not in an expanded position.

According to an aspect that may be combined with any one or more other aspects herein, a block includes a cut-out or other feature in which a link is at least partially located while the block is in a retracted position but not in an expanded position.

According to an aspect that may be combined with any one or more other aspects herein, a cut-out or other feature extends axially, radially, or both axially or radially in a block or blade. According to an aspect that may be combined with any one or more other aspects herein, the expanded blade is configured to cut a workpiece when moving axially in a downward direction.

According to an aspect that may be combined with any one or more other aspects herein, the expanded blade is configured to cut a workpiece when moving axially in an upward direction.

According to an aspect that may be combined with any one or more other aspects herein, the blade is configured to pivot about a pin in an uphole or downhole end portion of the blade.

According to an aspect that may be combined with any one or more other aspects herein, the blade has a blunt cutting edge.

According to an aspect that may be combined with any one or more other aspects herein, the blade has a tapered cutting edge.

According to an aspect that may be combined with any one or more other aspects herein, the expanded blade has a greater radial position at one axial end than at the other.

According to an aspect that may be combined with any one or more other aspects herein, an uphole axial end of the blade is radially outward of a downhole axial end of the blade when the blade is expanded.

According to an aspect that may be combined with any one or more other aspects herein, a downhole axial end of the blade is radially outward of an uphole axial end of the blade when the blade is expanded.

According to an aspect that may be combined with any one or more other aspects herein, a cutting feature is tapered.

According to an aspect that may be combined with any one or more other aspects herein, a taper is step-wise, linear, parabolic, or arcuate.

According to an aspect that may be combined with any one or more aspects herein, the body includes one or more splines that engage one or more splines on an exterior of the block.

According to an aspect that may be combined with any one or more aspects herein, the block includes one or more splines that engage one or more splines on an exterior of the blade.

According to an aspect that may be combined with any one or more aspects herein, the blade contacts a lug.

According to an aspect that may be combined with any one or more aspects herein, the lug is coupled to the block.

According to an aspect that may be combined with any one or more aspects herein, the lug is releasably coupled to the block.

According to an aspect that may be combined with any one or more aspects herein, the lug is at least partially receives or absorbs forces applied to the blade during a downhole milling or other operation.

According to an aspect that may be combined with any one or more aspects herein, one or more splines on the block, the body, or the blade at least partially receive or absorb forces applied to the blade during a downhole milling or other operation.

According to an aspect that may be combined with any one or more aspects herein, receiving or absorbing forces includes relieving the at least one link of such forces.

According to an aspect that may be combined with any one or more other aspects herein, a downhole tool mills an outer casing.

According to an aspect that may be combined with any one or more other aspects herein, a downhole tool mills an inner casing.

According to an aspect that may be combined with any one or more other aspects herein, a downhole tool mills cement between an inner and outer casing.

According to an aspect that may be combined with any one or more other aspects herein, any two or more of an inner casing, outer casing, or cement between the inner and outer casing are milled simultaneously by a downhole tool.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. It should be understood that any directions or reference frames in the preceding description are merely relative directions or movements. For example, any references to "up" and "down," "above" and "below," or "uphole" and "downhole" are merely descriptive of the relative position or movement of the related elements.

Any element described in relation to an embodiment or a figure herein may be combinable with any element of any other embodiment or figure described herein. Numbers, percentages, ratios, or other values stated herein and in the claims are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Components or elements that are coupled together may be directly coupled or indirectly coupled (e.g., using one or more intermediate components). Integral components should also be understood to be coupled together.

A person having ordinary skill in the art will realize in view of the present disclosure that equivalent constructions do not depart from the scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool comprising:

a tool body having at least one recess therein;

a block in the recess in the tool body, the block configured to move radially between retracted and expanded states within the recess and relative to the tool body;

a blade recessed relative to the block, the blade configured to move radially, relative to the block, between retracted and expanded states; and one or more links pivotally coupled to the blade and to the tool body.

2. The downhole tool of claim 1, the one or more links having opposing end portions pivotally pinned at fixed locations relative to the tool body and the blade.

3. The downhole tool of claim 1, the tool body including angled splines on one or more lateral surfaces adjacent the recess, the angled splines of the tool body engaging angled splines on the block.

4. The downhole tool of claim 1, the at least one link being configured to pivot relative to the tool body when the blade moves between the retracted and expanded states.

5. The downhole tool of claim 1, the blade configured to move radially by pivoting relative to the block.

6. The downhole tool of claim 5, the blade being pinned at a fixed location to the block.

7. The downhole tool of claim 1, the blade being pinned at an uphole end portion of the block.

8. The downhole tool of claim 1, the blade being pinned at a downhole end portion of the block.

9. The downhole tool of claim 1, the blade configured to move axially and radially relative to the block and the tool body when the blade moves between the retracted and expanded states.

10. The downhole tool of claim 9, the block including angled splines adjacent a recess in the block, the angled splines of the block engaging angled splines of the blade.

11. The downhole tool of claim 1, the blade including a tapered cutting element having, at least when in the expanded state of the blade, a greater radial position at an uphole end portion of the cutting element than at a downhole end portion of the cutting element.

12. The downhole tool of claim 1, the tapered cutting element including a linear, step-wise, parabolic, or arcuate taper.

13. The downhole tool of claim 1, the block and the blade including one or more cut-outs configured to receive the one or more links therein.

14. A downhole milling tool, comprising:

a tool body including at least one recess in an external surface of the tool body;

at least one cutting block in the at least one recess, the at least one cutting block configured to extend radially outward relative to a central axis of the tool body toward a cutting block extended position and to retract radially inward relative to the central axis of the tool body toward a cutting block retracted position;

at least one milling blade in a recess in the at least one cutting block, the at least one milling blade configured to extend radially outward relative to the cutting block to a milling blade extended position and to retract radially inward relative to the cutting block toward a milling blade retracted position; and at least one link pinned to the at least one milling blade and to the tool body of the milling tool.

15. The downhole milling tool of claim 14, the milling tool being configured to extend radially outward relative to the cutting block simultaneously with the cutting block extending radially outward relative to the tool body, and to retract radially inward relative to the cutting block simultaneously with the cutting block retracting radially inward relative to the tool body.

16. The downhole milling tool of claim 14, the at least one milling blade being configured to rotate about a pin coupling the at least one milling blade to the at least one cutting block.

17. The downhole milling tool of claim 14, the at least one milling blade lacking a pin coupling the at least one milling blade to the at least one cutting block.

18. A method for milling a casing string in a wellbore, the method comprising:

rotating a milling tool at a starting downhole position in a wellbore, the milling tool including a cutting block in a tool body, a milling blade in the cutting block, and one or more links pivotally coupled to the blade and to the tool body;

extending the cutting block radially outward relative to the tool body and, at the same time, extending the milling blade radially outward relative to the cutting block;

cutting an outer casing string with the milling blade; and removing an axial section of the outer casing string by moving the milling tool in an axial direction while the cutting block and the milling blade remain radially extended.

19. The method of claim 18, further comprising:

removing at least a portion of a cement layer on an inner surface of the outer casing string at the starting downhole position with at least one of the cutting block or the milling blade extended.

20. The method of claim 18, wherein extending the milling blade includes at least one of:

pivoting a first axial end portion of the milling blade radially outward from the cutting block; or translating the milling blade along an angled path moving the milling blade axially and radially relative to the cutting block.

21. A method for milling a casing string in a wellbore, the method comprising:

rotating a milling tool at a starting downhole position in a wellbore, the milling tool including a cutting block in a tool body, a milling blade in the cutting block, and at least one fixed length link directly coupling the milling blade to the tool body;

extending the cutting block radially outward relative to the tool body and, at the same time, extending the milling blade radially outward relative to the cutting block; wherein the fixed length of the fixed length link causes the blade to move radially relative to the cutting block when the cutting block moves axially;

cutting an outer casing string with the milling blade; and removing an axial section of the outer casing string by moving the milling tool in an axial direction while the cutting block and the milling blade remain radially extended.

22. The method of claim 21, further comprising:

removing at least a portion of a cement layer on an inner surface of the outer casing string at the starting downhole position with at least one of the cutting block or the milling blade extended.

23. The method of claim 21, wherein extending the milling blade includes at least one of:

pivoting a first axial end portion of the milling blade radially outward from the cutting block; or translating the milling blade along an angled path moving the milling blade axially and radially relative to the cutting block.

* * * * *